United States Patent [19]

Tassie et al.

[11] Patent Number: 4,924,752

[45] Date of Patent: May 15, 1990

[54] DRIVE SYSTEM FOR A GATLING TYPE GUN

[75] Inventors: Douglas P. Tassie; Mark F. Folsom, both of St. George, Vt.

[73] Assignee: General Electric Company, Burlington, Vt.

[21] Appl. No.: 677,415

[22] Filed: Dec. 3, 1984

[51] Int. Cl.[5] ..... F41D 7/04

[52] U.S. Cl. ..... 89/160; 89/12

[58] Field of Search ..... 89/9, 11, 12, 159, 160

[56] References Cited

U.S. PATENT DOCUMENTS

| | | | |
|---|---|---|---|
| 2,756,639 | 7/1956 | Bird | 89/160 |
| 2,849,921 | 9/1958 | Otto | 89/12 |
| 3,311,022 | 3/1967 | Bernard et al. | 89/126 |
| 3,407,701 | 10/1968 | Chiabrandy | 89/126 |
| 3,535,979 | 10/1979 | Ashley | 89/1 |
| 3,568,563 | 3/1971 | Folsom | 89/126 |
| 3,703,122 | 11/1972 | Farrington | 89/14 |
| 3,991,650 | 11/1976 | Garland et al. | 89/43 |
| 4,004,490 | 1/1977 | Dix et al. | 89/33 |
| 4,046,056 | 9/1977 | Carrie | 89/12 |
| 4,342,253 | 8/1982 | Kirkpatrick et al. | 89/12 |

OTHER PUBLICATIONS

USAF T.O.11W1-28-8-2 issued Jul. 1, 1976, cover page, pp. 1-1 to 1-5 and 3-1 to 3-4.

"Machine Design," 9/29/83, p. 159.

*Primary Examiner*—Stephen C. Bentley

*Attorney, Agent, or Firm*—Bailin L. Kuch

[57] ABSTRACT

A gun system is provided which includes a Gatling type gun having a housing with a ring gear, a rotor with a cluster of gun barrels, a gun gas drive mechanism with a cylinder, a piston, and a crank with a pinion meshed with the ring gear.

2 Claims, 6 Drawing Sheets

DRIVE SYSTEM FOR A GATLING TYPE GUN

BACKGROUND OF THE INVENTION

1. Field of the Invention

This invention relates to Gatling type guns which are self powered and self starting.

2. Description of the Prior Art

Externally powered automatic gun systems conventionally have a reliability about one order of magnitude greater than that of self powered guns. In the heavier caliber machine guns, the self power is conventionally a recoil or gas operated direct drive system; while the external power is conventionally an electric motor, a pneumatic drive or a hydraulic drive. This is true even for Gatling type guns, which are continuous motion systems, and have been conventionally inherently more reliable than single barrel guns which are reciprocating systems.

H. M. Otto in U.S. Pat. No. 2,849,921 issued Sept. 2, 1958 shows a modern Gatling type gun driven by an external electric motor.

R. R. Bernard et al in U.S. Pat. No. 3,311,022 issued Mar. 28, 1967, and R. E. Chiabrandy in U.S. Pat. No. 3,407,701 issued Oct. 29, 1968, show modern Gatling type guns driven by an internal gas piston.

E. Ashley et al in U.S. Pat. No. 3,535,979 issued Oct. 27, 1979 show a self cocking spring starter and brake for a Gatling type mechanism.

L. R. Folsom in U.S. Pat. No. 3,568,563 isssued Mar. 9, 1971 shows a modern Gatling type gun wherein an internal gun gas vane motor biases a spring which drives the gun.

D. A. Farrington in U.S. Pat. No. 3,703,122 issued Nov. 21, 1972 shows a muzzle torque assist device for a Gatling type gun.

N. C. Garland et al in U.S. Pat. No. 3,991,650 issued Nov. 16, 1976 shows a hydraulic system for starting and driving a Gatling type gun which derives its energy from the recoil motion of the gun.

G. W. Carrie in U.S. Pat. No. 4,046,056 issued Sept. 6, 1977 shows a pneumatic system for starting and driving a Gatling type gun which derives its energy from a pressurized tank.

An electrohydraulic drive assembly, continually powered by the aircraft hydraulic system, is disclosed in U.S.A.F. T.O.11W1-28-8-2, issued July 1, 1976.

SUMMARY OF THE INVENTION

It has been found that the energy that can be derived from the recoil motion of the housing of a Gatling type gun to power a system for starting and driving the gun is quite limited, and thereby limits the rate of fire of the gun. However, adequate surplus energy is available from the rotation of the cluster of barrels having a muzzle torque device on a Gatling type gun to recharge a hydraulic system for starting and driving the gun.

An object of this invention is to provide a gun gas drive for a Gatling type gun to be utilized with a system for initiating rotation of cluster of gun barrels of said gun.

A feature of this invention is the provision of a gun system including a Gatling type gun having a housing and a cluster of gun barrels journaled for rotation with respect to said housing, and a gun gas drive coupled to and between said cluster and said housing for receiving gun gas from said gun barrels and for thereby rotating said cluster with respect to said housing.

BRIEF DESCRIPTION OF THE DRAWING

These and other objects, features and advantages of the drawing will be apparent from the following specification thereof taken in conjunction with the accompanying drawing in which.

DESCRIPTION OF THE INVENTION

Figure 1:
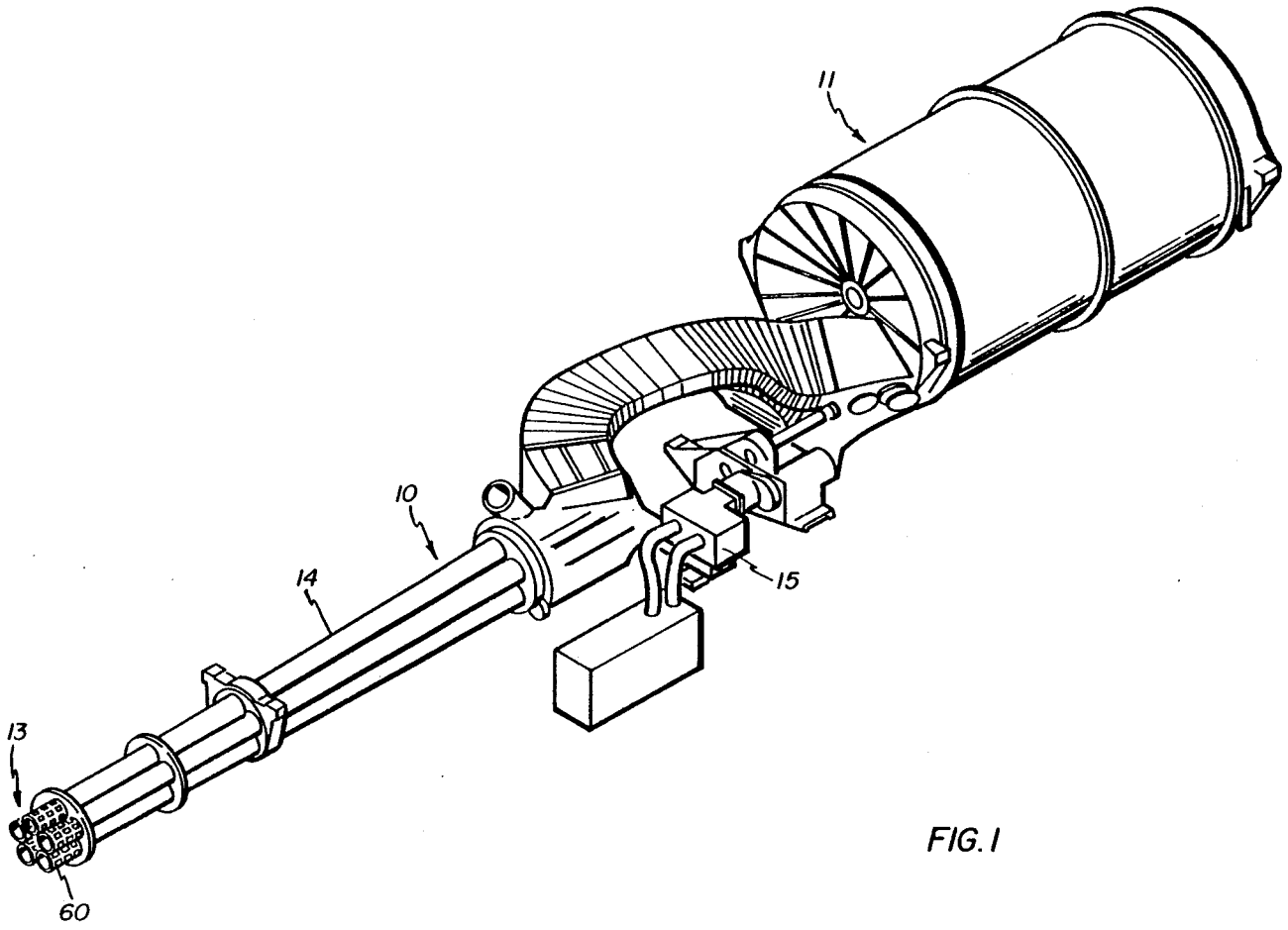
FIG. 1 is a perspective view of a gun system embodying this invention.

A gun system embodying this invention is shown in FIG. 1. It includes a Gatling type gun 10, which, for example, may be of the type shown in U.S. Pat. No. 4,342,253 issued Aug. 3, 1982 to R. G. Kirkpatrick et al, and an ammunition handling system 11, which, for example, may be of the type shown in U.S. Pat. No. 4,004,490 issued Jan. 25, 1977 to J. Dix et al.

Figure 2:
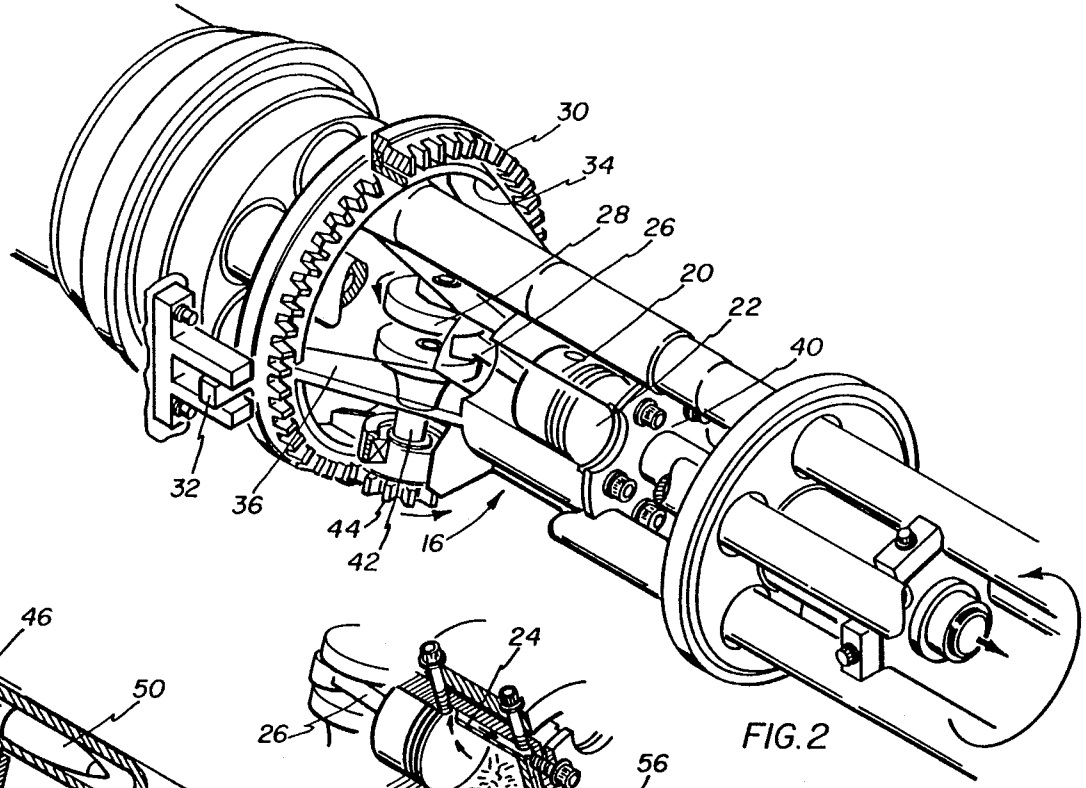
FIG. 2 is a perspective view of a gun gas drive to provide steady-state energy for the rotation of the barrel cluster of the gun.

The system has two main drive components: a gun gas drive system (shown in FIG. 2), together with a torque assist device 13 on the rotating cluster 14 of gun barrels to provide steady-state energy; and a hydraulic starter system 15 to provide initial acceleration, rate control, braking, and reverse clearing. The gun gas drive and torque assist device are capable of producing a significant amount of energy above that needed by the gun at some desired rate of fire. This surplus energy is used to recharge a hydraulic drive system which includes a high pressure hydraulic source which is coupled to a hydraulic motor which is used to provide the initial acceleration or starting function of the gun. This hydraulic system is also used to provide reverse clearing, control of the rotational velocity and dynamic braking of the gun. The hydraulic system, after initial charging, requires no external power other than for control signals, (such as start and stop) from an electrical control unit. The system obviates the conventional use of heavy and bulky drive units and their associated power supplies in aircraft and turret gun installations.

Figure 8:
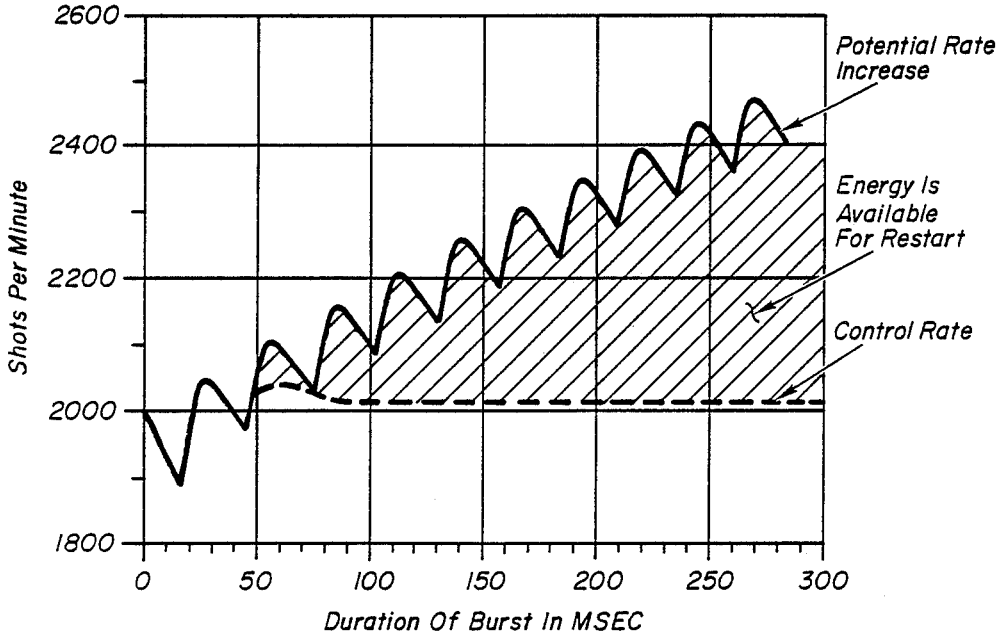
FIG. 8 is a graph of the energy available for powering the subsystem of FIG. 5.

FIG. 8 shows that energy will be available for charging the storage system. The power output of the piston drive is a direct function of the rotational velocity of the gun. The power output of the muzzle torque is a function of the square of the rotational velocity of the gun. The rotational velocity of the gun is a direct function of the rate of fire of the gun. The difference between the rotational velocity of 2000 shots per minute at which the gun is constrained and the potential, if unconstrained rate, in excess of 2400 shots per minute, shows that energy, which is a function of rotational velocity times the hold-back torque, is available for the storage system.

Figure 4:
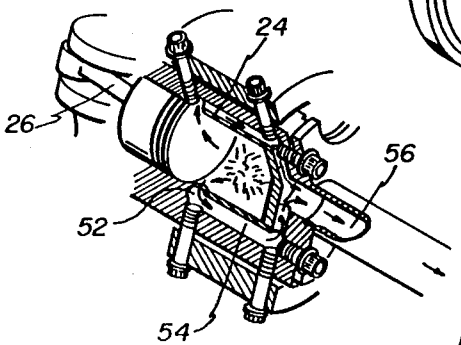
FIG. 4 is a detail of FIG. 2 showing the drive in its exhaust stroke.
Figure 3:
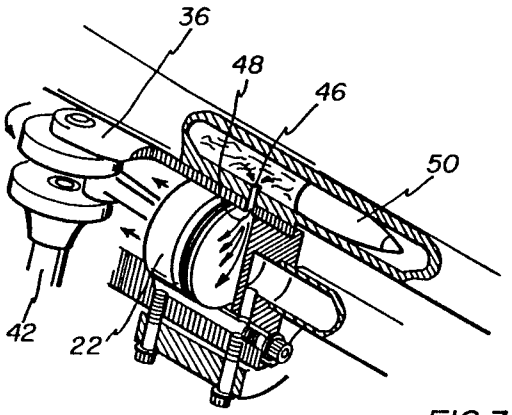
FIG. 3 is a detail of FIG. 2 showing the drive in its power stroke.

As shown in FIGS, 2, 3 and 4, the gun gas drive 16 includes a piston 20 whose head 22 is disposed within a cylinder 24 and whose rod 26 is pivotally coupled at its forward end to the head and at its aft end to a crank 28. A ring gear 30 is fixed to the housing as by a ground 32 and does not rotate. The ground may be adjustable to permit synchronizing the gear to the crank. An inner ring 34 has a plurality of arms 36, forming a spider, which are each fixed to the cylinder 24. The cylinder 24 is secured within and to the cluster 14 of barrels by a clamp plate 40. The crank has a pair of distally extending shafts 42 which are respectively journaled to the spider and one of which has a pinion gear 44 fixed thereto and meshed with the ring gear 30. Thus, as the piston 20 reciprocates, the crank is rotated and drives its pinion gear in orbit around the ring gear, together with the cylinder 24 and the cluster 14 of gun barrels. As shown in FIG. 3, a gas outlet port 46 in each gun barrel is aligned with a respective companion gas inlet port 48 in the forward end of the cylinder 24, permits the flow of a portion of the gun gas, which is propelling a projectile 50 along the bore of the respective gun barrel, into the forward end of the cylinder 24 to drive the piston head 22 aftwardly. When the piston head reaches the end of its aftward movement, it uncovers a gas outlet port 52, as shown in FIG. 4, which is coupled to an exhaust manifold 54 within the wall of the cylinder 24, which in turn is coupled to an exhaust tube 56. The piston makes a complete cycle of reciprocation as each gun barrel is fired. Thus a five barrel gun provides five cycles of reciprocation of the piston for each rotation of the cluster 14 of gun barrels. Although the gas ports connecting the cylinder to the non-firing barrels remain open during the power stroke of the piston, the rapid motion of the piston and its very large area, relative to that of the gas ports, assures that by far the greatest fraction of the expansion work taken from the gas is delivered to the piston and not to leakage flow. In addition, the quantity of energy available from the gas is great enough so that efficiency is not the primary consideration.

The ring and pinion gears may be either both bevel or conventional spur gear and a face gear.

The torque assist device 13 may, for example, be of the type shown in U.S. Pat. No. 4,574,682, issued Mar. 11, 1986, to by C. E. Hillman. The device includes a plurality of radial flow turbines 60, each centered on a respective gun barrel. Each turbine deflects portions of the gun gas radially and provides a respective pure torque centered on the respective gun barrel, and these torques translate into a summation torque centered on the longitudinal axis of the cluster of gun barrels without generating any lateral loads on the stationary portions of the gun.

Figure 5:
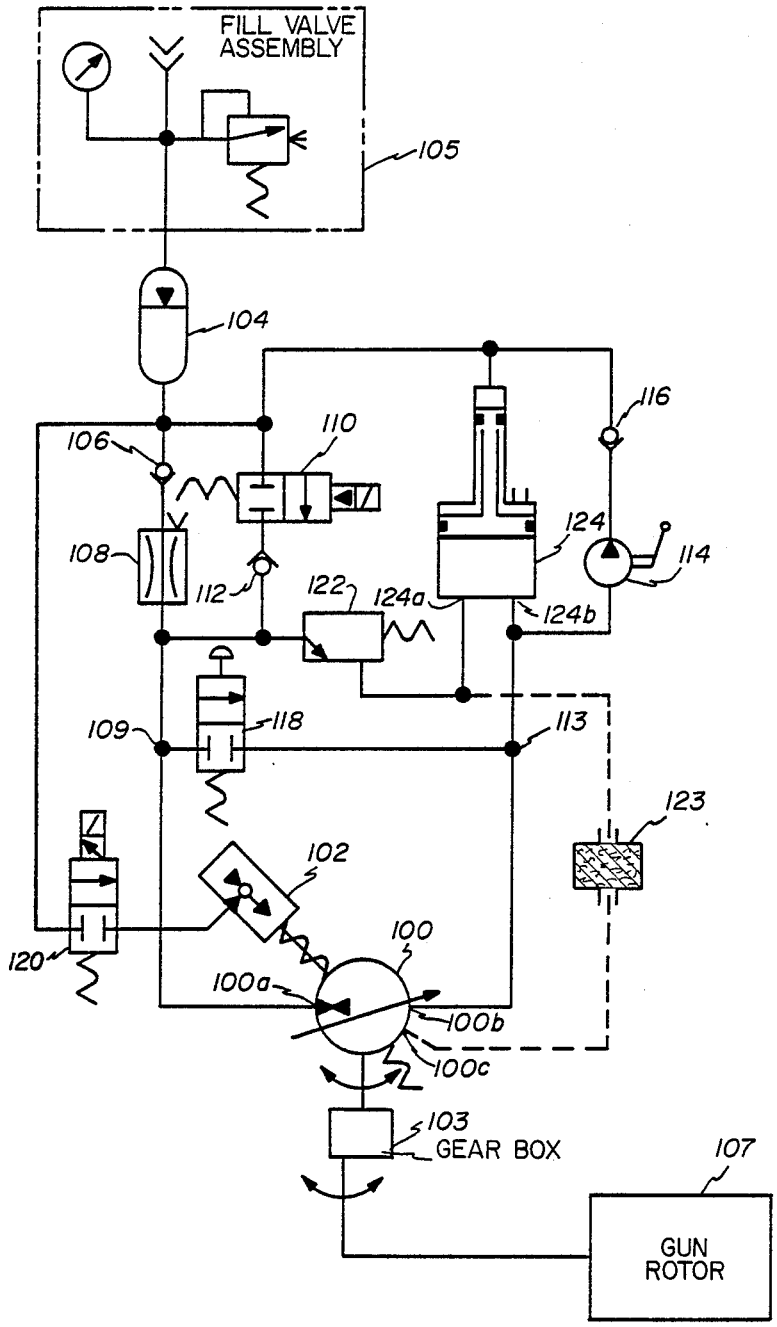
FIG. 5 is a schematic of a first embodiment of the hydraulic starting subsystem.
Figure 6:
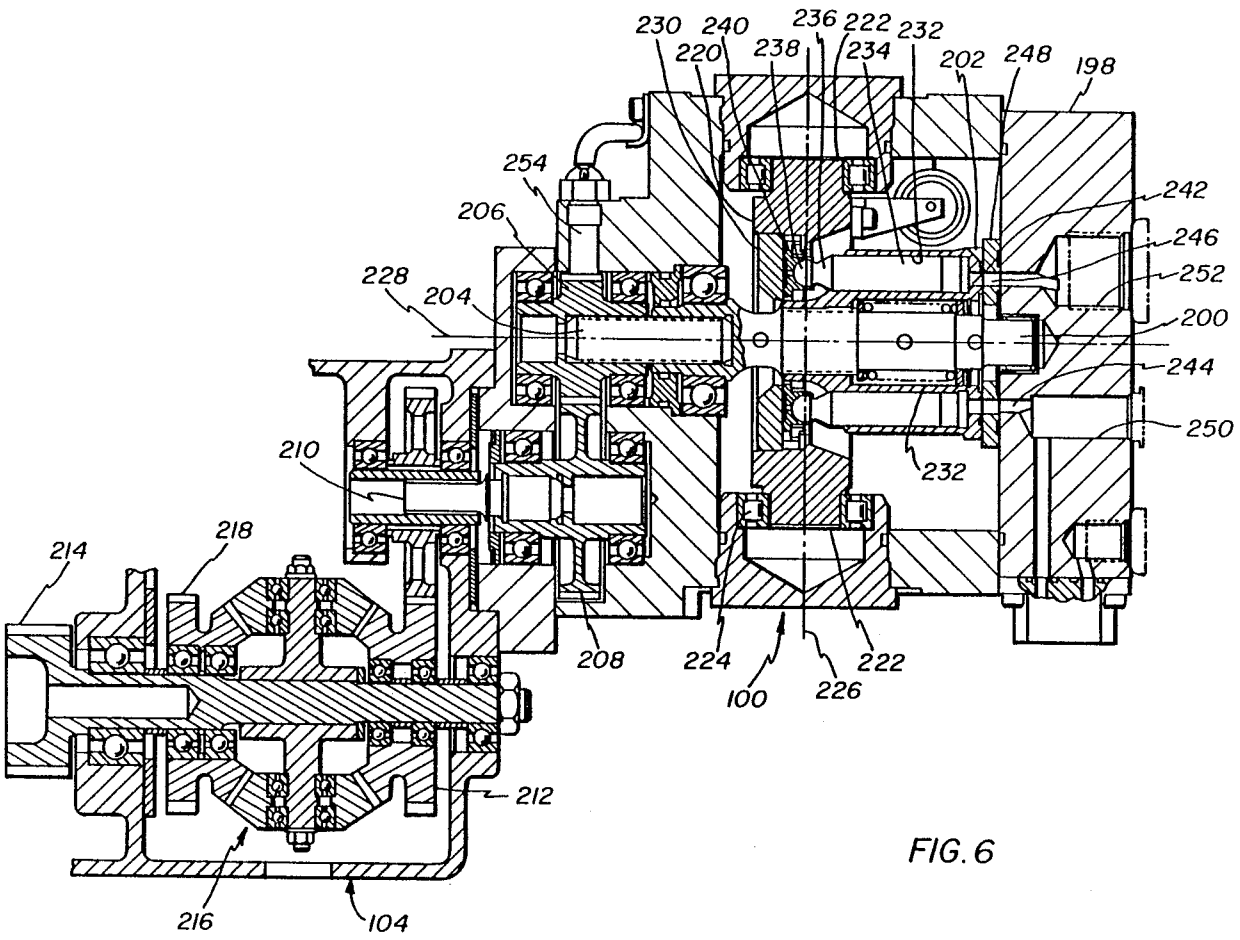
FIG. 6 is a view in longitudinal cross-section of the hydraulic servo pump/motor and gear box of the subsystem of FIG. 5.
Figure 7:
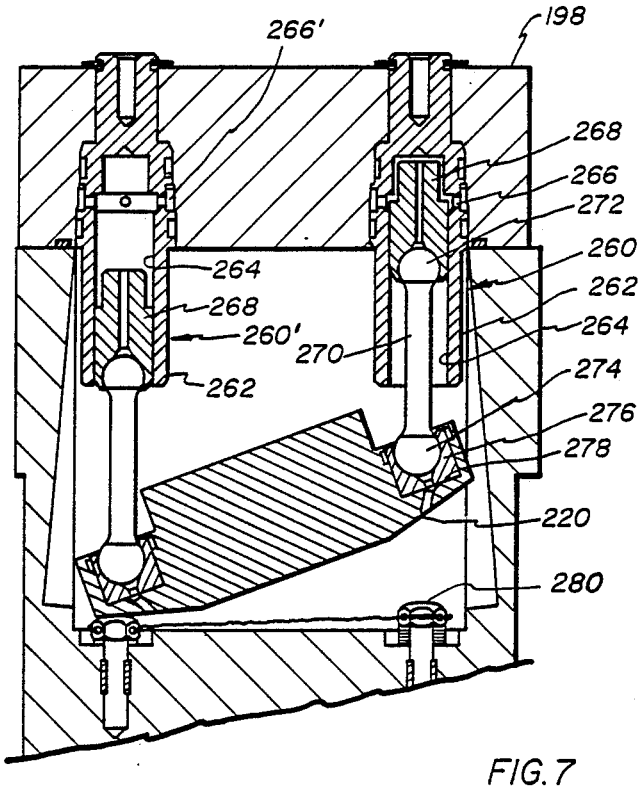
FIG. 7 is a view in longitudinal cross-section of a detail at 90° to FIG. 6.

A first embodiment of the hydraulic starting subsystem is shown in FIGS. 5, 6 and 7. A variable displacement overcenter piston pump/motor 100, with a servo actuator control 102 to control the angular position of the yoke, is mechanically coupled via a gear box 103 to the rotor 107 of the gun which includes the cluster 14 of gun barrels. As described in "Machine Design," 9/29/83, p. 159, the pump/motor 100 is an axial-piston motor which has a barrel which contains several pistons, usually seven to nine, that are extended by high pressure fluid. The pistons are restrained at one end by an angled plate carried by a yoke. As they sequentially are extended to bear against the plate, they generate a rotating force in which the pistons are rotated. In most designs, the shaft is driven directly from either the barrel or the cam plate; in a few hydraulic motors, the shaft is driven through a differential-gear arrangement that permits low speed and high torque. As a pump, the yoke is shifted overcenter to reverse its angular position, and the shaft drives the pistons.

An accumulator 104 has a fill valve assembly 105 which provides for the initial pressure charge of gas which is isolated from the hydraulic oil by a piston or bladder, and is coupled through a check valve 106 and a flow limit valve 108 in series through a high pressure junction 109 to the pump mode outlet port **100*a* of the pump/motor 100. The check valve 106 and the flow limit valve 108 are paralleled by a solenoid operated on/off valve 110 and a check valve 112. The pump mode inlet port 100*b* of the pump/motor 100 is coupled to a low pressure junction 113. A hand pump 114 and a check valve 116 are coupled in series between the accumulator 104 and the low pressure junction 113. A manually operated bypass valve 118 is coupled between the high pressure junction 109 and the low pressure junction 113. A solenoid operated on-off valve 120 couples the servo actuator control 102 to the accumulator 104. A system relief valve 122 is coupled between the high pressure junction 109 and one low pressure port 124*a* of a bootstrap reservoir 124 whose second low pressure port 124*b* is coupled to the low pressure junction 113. A filter 123 may be coupled between the case drain 100C of the motor 100 and the port 124*a* of the reservoir 124**.

To accelerate the rotor of the gun up to firing speed the servo on/off actuator 120 must open and energize the servo valve 102 to stroke the valve plate of the pump/motor overcenter from the pumping mode to the motor mode and the solenoid operated on/off valve 110 must be opened to couple the accumulator via high pressure junction 109 to the pump/motor. Pressure from the accumulator will be provided to the motor mode inlet port **100*a* to start and accelerate the rotor 106 of the gun via the gear box 104 in the forward/firing direction of rotation. At full firing rate, the solenoid operated on/off valve 110** must be closed.

At normal gun load torque, the pump 100 operating at full displacement is adequate at low accumulator pressure to limit the rotational velocity of the rotor of the gun. During firing the accumulator is refilled by the pump 100 through the flow limit valve 108 and the check valve 106, raising the pressure charge of the accumulator to normal or above. The servo control 102 will reduce the displacement of the pump as the pressure in the accumulator rises, so that the total load torque of the system matches the output torque of the gas drive including muzzle torque assist at the firing rate to control the rotational velocity of the barrel cluster. If the barrel cluster changes its rotational velocity, the servo will adjust the pump displacement and the pumping load to maintain or return to the firing rate.

If the gun load torque is below normal, the pump at full displacement will reach the setting of the flow limit valve at rated barrel cluster rotational velocity and the flow limit valve will provide the necessary backpressure to limit the rotational velocity of the barrel cluster until the accumulator is charged to the required higher backpressure.

On longer than normal bursts of firing, the accumulator will be overfilled to higher than normal pressure.

The system relief valve 122 is set to limit the maximum accumulator charge pressure during such bursts by opening and shunting fluid through the ports 124*a* and 124*b* of the bootstrap reservoir 124 to the low pressure junction 113.

When the firing pins of the gun bolts of the gun are safed, halting percussing of ammunition, gun gas is no longer generated and the gun gas drive is no longer energized, and the gun torque load and the pump will brake the barrel cluster to a stop. The check valve 106 precludes reverse rotation of the pump as a motor. The solenoid on-off valve 110 is energized at full stop, pressurizing the motor mode inlet port 100*a* via the high pressure junction 109, to cause the pump/motor to act as a motor in the reverse clearing direction, i.e., rotating the barrel cluster in the not-firing direction of rotation. Upon clearing being completed, the valve 110 is denergized, withdrawing high pressure from the junction 100*a* to halt reverse direction motor function.

As seen in FIGS. 6 and 7 the hydraulic servo pump-/motor 100 and gear box 104 includes a housing 198 having a pump/motor shaft 200 which is splined to a cylinder block or sleeve 202 and also splined to a coupling shaft 204 which in turn is splined to an input shaft and gear 206 which is meshed with an output shaft and gear 208 which is splined to an output coupling shaft 210 which is splined to a gear box input shaft and gear 212 which in turn is meshed with the input gear 214 of a differential gear assembly 216 whose output shaft and gear 218 is ultimately coupled to a ring gear on the rotor of the gun whereby to drive the cluster of gun barrels, the feeder and the ammunition handling system.

The yoke 220 has two integral, coaxial stub shafts 222 which are journaled for pivoting in respective roller bearings 224 about an axis 226 which is perpendicular to the axis of rotation 228 of the shaft 200. An annular wear plate 230 is fixed to and pivots with the yoke. The cylindrical block 202 which is splined to and rotates with the shaft 200 has a plurality of cylinders 232 disposed in an annular row which is concentric with the axis 228. Each cylinder 232 has a respective piston 234 having an integral piston rod 236, which rod terminates in a ball 238, which ball carries a shoe 240, and which shoe rides against the wear plate 230. Each cylinder 232 has a port 242 which once during each rotation of the block 202 about the axis 228 is sequentially aligned with a high pressure port 244 and a low pressure port 246 in a stationary valve plate 248. The port 242 is coupled via a manifold 250 to the high pressure junction 109. The port 246 is coupled via a manifold 252 to the low pressure junction 113.

A magnetic sensor 254 is fixed adjacent the teeth of the input gear and shaft 206 to provide an output signal which may be utilized to determine the rotational velocity of the shaft 200.

The tilt of the yoke 220 is controlled by two piston assemblies 260 and 260[1]. Each piston assembly is fixed to the housing 198 and includes a respective piston sleeve 262 having a cylinder 264, a port 266, and a piston 268. Each piston has a respective piston rod 270 with an upper knuckle 272 captured by the piston 268 and a lower knuckle 274 captured by a shoe 276 which is captured in a socket 278 in the yoke. Two yoke stops 280 are respectively fixed to the housing opposite the pistons to limit the travel in extension of the pistons. One port 266 is coupled via a conduit to the high pressure manifold 250. The other port 266[1] is coupled via a conduit to a servo control manifold.

Figure 9:
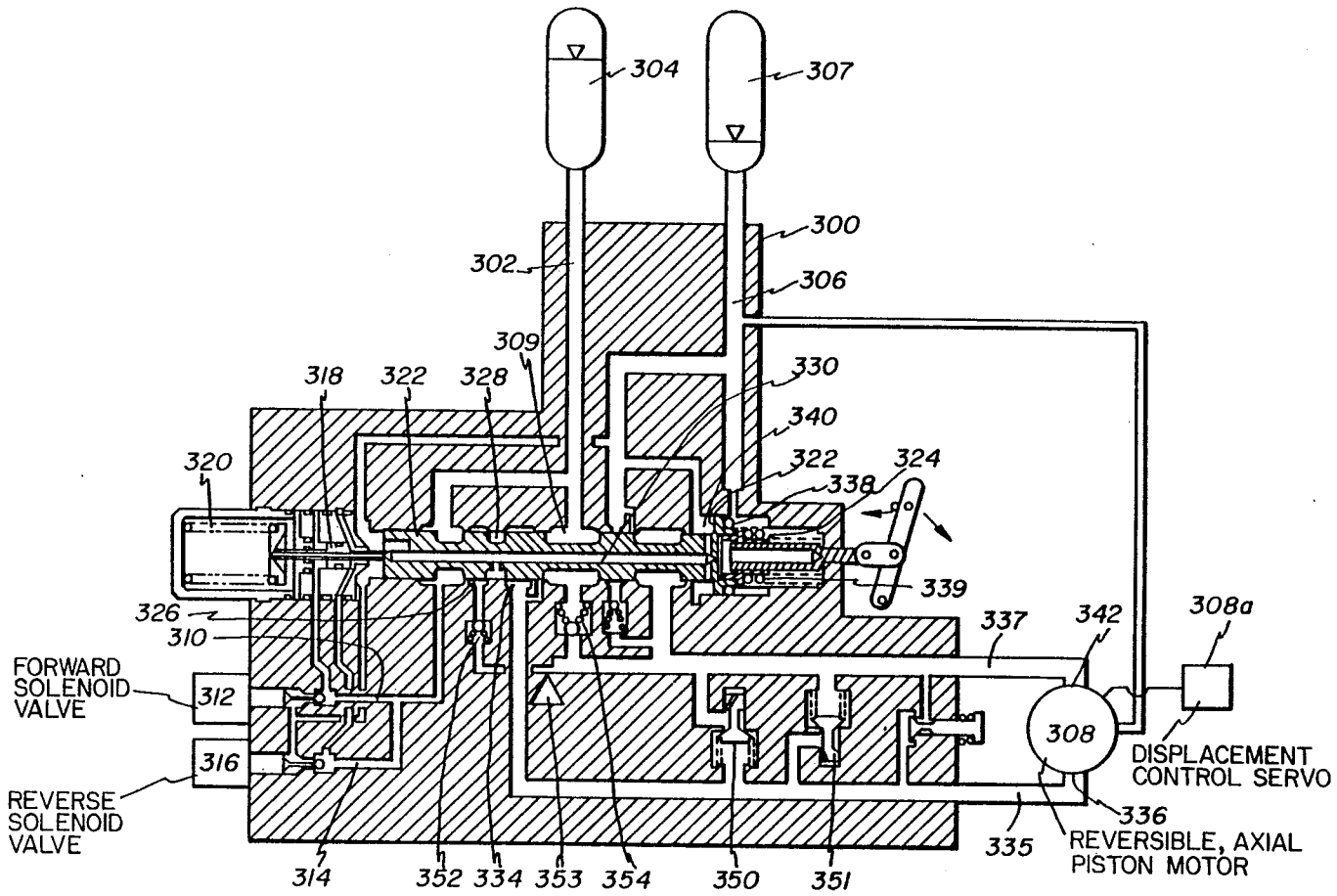
FIG. 9 is a schematic of a second embodiment of the hydraulic starting subsystem.

An alternative embodiment of the hydraulic starting subsystem is shown in its off disposition in FIG. 9. A housing 300 has a high pressure manifold 302 coupled to a high pressure accumulator 304 and a low pressure manifold 306 coupled to a low pressure accumulator 307. These accumulators are coupled by the subsystem to an axial piston motor 308 which is reversible depending on which of its main ports is coupled to high pressure and has a displacement which is progressively variable between a maximum and a minimum. Air pressure within the accumulators may be supplied by a separate rechargable air bottle, not shown.

In the off disposition, high pressure at the high pressure manifold 302 is supplied to the inlet 310 of a forward solenoid valve 312, to the inlet 314 of a reverse solenoid valve 316, and to both sides of a control piston 318. The equal high pressures applied to both sides balances the control piston 318 and allows a spring 320 to bias a motor control spool 322 to the right in the closed (or off) position against a stop 324. A notch 334, via a manifold 335, connects the motor inlet port 336 to a chamber 328 which is at low pressure. Motor outlet port 342 is also connected to low pressure via manifold 337 thereby preventing any possibility of motor creep in the off position.

When a trigger signal is applied, the forward solenoid valve 312 is energized and high pressure is removed from the left side of control piston 318. High pressure on the right side of the control piston 318 forces the piston to the left, compressing the spring 320. This permits a spring 338 to move the motor control spool 322 to the left, admitting high pressure from the manifold 302, via chamber 309, to the manifold 335, and the motor 308 starts to accelerate the gun to full speed. During this acceleration, the gas drive 16 supplements the motor in bringing the gun up to full speed as rounds are being fired. When the motor and gun reach approximately ninety percent of full speed, a speed sensor, not shown, signals an electronic controller, not shown, to simultaneously de-energize the forward solenoid valve 312 and energize the reverse solenoid valve 316. These valves now apply pressure to the left side of control piston 318 and remove pressure from the right side. The combined force of spring 320 and the control piston 318 moves the motor control spool 322 to the right, past the normal closed (off) position, into the reverse position where it compresses the springs 338 and 339. The stop 324, which locates the off position of the motor control spool 322, is held to the left by the force of spring 339. The inlet 336 to the motor is now connected to the low pressure accumulator 307 through a chamber 340, the center bore 330 of the motor control spool, and the notch 334. The outlet 342 of the motor is now connected to the high pressure accumulator 304 through check valve 354 as the normal outlet path to the low pressure accumulator is blocked. This configuration is maintained during steady state gun firing as the gas drive supplies power to the gun system and, in addition, drives the motor 308 as a pump to recharge the high pressure accumulator 304 through check valve 354. If and when the high pressure accumulator pressure has reached a preset limit, a forward relief valve 350 opens and fluid pumped from the motor outlet 342 is recirculated to the motor inlet 336.

In order to maintain steady state speed control in the forward direction, the displacement of motor 308 must be variable in order to produce a constant load torque, as required in the first embodiment of the hydraulic starting subsystem. As the pressure in the high pressure accumulator 304 rises as the accumulator is recharged by the motor, the displacement of the motor must be lowered in order for its load torque to remain constant. A displacement control servo 308a performs this function.

When the trigger signal is released and after the last round has been fired, the gas drive 16 ceases providing power and the gun system decelerates rapidly due to the continued load thereon of the motor 308 being driven as a pump by the rotational inertia of the gun system. The motor control spool 322 remains in the reverse position during this time and, depending upon the length of the burst, either controls the gun system to recharge the high pressure accumulator 304 or to recirculate fluid from the motor outlet 342 to the motor inlet 336 as previously described.

As the motor reaches zero speed, high pressure from the accumulator 304 via the motor control spool flows through notch 336, the check valve 352, and the flow restrictor 353 to the outlet port 342 of the motor and accelerates the motor in its reverse direction. The reverse speed of the motor is controlled by the setting of the flow restrictor 353.

The controller de-energizes the reverse solenoid valve after the unfired rounds in the gun have been fed back out of the gun. When the reverse solenoid valve is de-energized, high pressure is applied to the right side of control piston 318 and the combined force of spring 338 and spring 339 moves the motor control spool 322 to the left. As the motor control spool moves to the left, the force of spring 339 is also applied to the stop 324 causing it to move in the same direction until it reaches the end of its travel in the off position. With the stop 324 in the off position, the spring 339 is prevented from moving the motor control spool 322 further to the left and the motor control spool is held in the closed (or off) position against the stop 324 by the force of the spring 320 which exceeds the opposing force of the spring 338. When the pressure reaches the setting of the reverse relief valve 351, the reverse relief valve opens. With the reverse relief valve open, the hydraulic fluid flows from the motor inlet 336 to the motor outlet 342. The fluid continues to be recirculated in this manner until the motor reaches a standstill.

What is claimed is:

1. A gun system including:

a gun housing;

a rotor including a cluster, of gun barrels disposed in an annular row, journaled for rotation about a longitudinal axis with respect to said housing, each barrel having a projectile passing bore in which a respective round of ammunition is fired in sequence during rotation of said rotor;

a gun gas drive mechanism coupled to and between said rotor and said housing for receiving gun gas from said gun barrels and for thereby rotating said rotor with respect to said housing;

said mechanism including a cylinder fixed to and rotating with said rotor, a crank journaled to said rotor for rotation with said rotor about said rotor longitudinal axis and for rotation relative to said rotor about a crank axis which is perpendicular to said rotor longitudinal axis.

a pinion gear fixed to said crank for rotation therewith about said crank axis, a piston having a head disposed and reciprocable within said cylinder and defining a chamber in said cylinder and a rod coupled to said crank whereby reciprocation of said piston causes rotation of said crank about said crank axis, a ring gear fixed to said housing and meshed with said pinion gear whereby rotation of said crank about said crank axis provides rotation of said rotor about said rotor longitudinal axis.

2. A gun system according to claim 1 wherein:

each of said gun barrels has a respective passageway leading from the projectile passing bore of the gun barrel to said chamber, whereby as the respective round of ammunition is fired in each gun barrel in sequence, a quantity of gun gas is passed through the respective passageway into said chamber to provide a full reciprocation of said piston.

* * * * *